US009719429B2

(12) United States Patent
Morris

(10) Patent No.: US 9,719,429 B2
(45) Date of Patent: Aug. 1, 2017

(54) DRIVER-ASSISTED FUEL REDUCTION STRATEGY AND ASSOCIATED APPARATUS, SYSTEM, AND METHOD

(75) Inventor: Andrew A. Morris, Franklin, IN (US)

(73) Assignee: Cummins IP, Inc., Minneapolis, MN (US)

( * ) Notice: Subject to any disclaimer, the term of this patent is extended or adjusted under 35 U.S.C. 154(b) by 561 days.

(21) Appl. No.: 13/462,691

(22) Filed: May 2, 2012

(65) Prior Publication Data

US 2013/0297185 A1 Nov. 7, 2013

(51) Int. Cl.
*F02D 11/10* (2006.01)
*F02D 41/24* (2006.01)

(52) U.S. Cl.
CPC ..... *F02D 11/105* (2013.01); *F02D 11/106* (2013.01); *F02D 41/2422* (2013.01); *F02D 2200/0404* (2013.01); *F02D 2200/602* (2013.01); *F02D 2200/604* (2013.01); *F02D 2200/606* (2013.01)

(58) Field of Classification Search
CPC .... F02D 11/105; F02D 11/106; F02D 41/045; F02D 41/30; F02D 41/3005; F02D 2200/0625; F02D 2200/60; F02D 2200/604; F02D 2200/606
USPC ..... 701/103, 104, 110, 115; 123/472, 478, 123/480, 486, 492
See application file for complete search history.

(56) References Cited

U.S. PATENT DOCUMENTS 4,949,694 A 8/1990 Nagaishi et al.
4,976,239 A 12/1990 Hosaka
5,383,431 A * 1/1995 Nishimura et al. ..... 123/399
5,693,876 A 12/1997 Ghitea, Jr. et al.
5,983,156 A * 11/1999 Andrews ..... 701/115
6,092,021 A 7/2000 Ehlbeck et al.
6,151,549 A * 11/2000 Andrews et al. ..... 701/115
6,157,888 A 12/2000 Suzio et al.
RE37,434 E 11/2001 Onari et al.
6,470,256 B1 * 10/2002 Cikalo ..... B60K 31/04 123/350
6,553,301 B1 4/2003 Chhaya et al.
(Continued)

FOREIGN PATENT DOCUMENTS

EP 1188602 B1 3/2006
JP 60166733 A * 8/1985

*Primary Examiner* — Erick Solis
*Assistant Examiner* — Anthony L Bacon
(74) *Attorney, Agent, or Firm* — Foley & Lardner LLP

(57) ABSTRACT

According to one embodiment, an apparatus for controlling fuel consumption in an internal combustion engine of a vehicle having a driver-actuated accelerator pedal includes an economy mode activation module and a standard fueling module. The economy mode activation module is configured to compare throttle input data with defined limits. The throttle input data is controllable by a driver of the vehicle via positioning of the accelerator pedal. The economy mode activation module is configured to control the fuel consumption of the internal combustion engine via an economy fuel map if the throttle input data falls within the defined limits for a defined amount of time. The standard fueling mode activation module is configured to control the fuel consumption of the internal combustion engine via a standard fuel map if the throttle input data does not fall within the defined limits for the defined amount of time.

18 Claims, 6 Drawing Sheets

(56) References Cited

U.S. PATENT DOCUMENTS

| | | | | |
|---|---|---|---|---|
| 6,694,806 | B2 | 2/2004 | Kumagai et al. | |
| 6,965,826 | B2 | 11/2005 | Andres et al. | |
| 7,490,000 | B2 * | 2/2009 | Siddiqui et al. | 701/104 |
| 7,512,471 | B2 * | 3/2009 | Nakamura et al. | 701/50 |
| 7,587,268 | B2 * | 9/2009 | Tagami et al. | 701/102 |
| 7,591,135 | B2 * | 9/2009 | Stewart | 60/600 |
| 7,765,058 | B2 | 7/2010 | Doering | |
| 8,037,870 | B2 * | 10/2011 | Saito et al. | 123/492 |
| 2007/0213176 | A1 * | 9/2007 | Fujii | B60W 10/06 477/107 |
| 2009/0093941 | A1 * | 4/2009 | Drazich | 701/103 |
| 2009/0173311 | A1 | 7/2009 | Roberts et al. | |
| 2013/0211643 | A1 * | 8/2013 | Cox et al. | 701/22 |

* cited by examiner

DRIVER-ASSISTED FUEL REDUCTION STRATEGY AND ASSOCIATED APPARATUS, SYSTEM, AND METHOD

FIELD

This disclosure relates generally to controlling the fuel consumption in an internal combustion engine, and more specifically to reducing the fuel consumption in an internal combustion engine based on throttle position characteristics.

BACKGROUND

In view of stricter regulations and higher oil prices, the automotive industry has been aimed at lowering fuel consumption for automobiles powered by internal combustion engines. However, one known trade-off associated with reducing fuel consumption (e.g., improving fuel economy) is a proportional reduction in performance. Although some people prefer improved fuel economy over performance, others would desire performance over fuel economy. Accordingly, recent advancements in the automotive industry have attempted to satisfy the demands of both types of driving preferences by reducing fuel consumption while minimizing losses in performance.

Some engine systems have been configured to improve fuel economy and reduce performance losses while operating in a single standard mode. In other words, such systems operate in a single operating mode.

Other engine systems can be switched between multiple modes of operation (e.g., performance mode and economy mode) via a user-accessible interface (e.g., a button, knob, or graphical user interface) depending on the preferences of the user. The ability to switch between multiple modes provides certain advantages. However, while such hand-operated interfaces may assist in facilitating relatively infrequent switching between semi-permanent modes of operation, they are not conducive to quick, frequent, and/or semi-automatic switching between modes of operation.

SUMMARY

The subject matter of the present application has been developed in response to the present state of the art, and in particular, in response to the problems and needs in the internal combustion engine art that have not yet been fully solved by currently available engine systems. Accordingly, the subject matter of the present application has been developed to provide an apparatus, system, and method for reducing fuel consumption via the assistance of a driver that promotes quick, frequent, and at least semi-automatic switching between fuel economy and normal operation modes that overcomes many of the shortcomings of the prior art.

According to one embodiment, an apparatus for controlling fuel consumption in an internal combustion engine of a vehicle having a driver-actuated accelerator pedal includes an economy mode activation module and a standard fueling module. The economy mode activation module is configured to compare throttle input data with defined limits. The throttle input data is controllable by a driver of the vehicle via positioning of the accelerator pedal. The economy mode activation module is configured to control the fuel consumption of the internal combustion engine via an economy fuel map if the throttle input data falls within the defined limits for a defined amount of time. The standard fueling mode activation module is configured to control the fuel consumption of the internal combustion engine via a standard fuel map if the throttle input data does not fall within the defined limits for the defined amount of time. The defined limits can include limits determined statically prior to operation of the engine or limits determined dynamically during operation of the engine.

In some implementations of the apparatus, the economy mode activation module is a steady state economy mode activation module and the throttle input data comprises throttle input values corresponding with positions of the accelerator pedal. The defined limits can include a throttle input value upper limit and a throttle input value lower limit. A throttle input percent difference between the upper limit and lower limit is between about 10% and about 75% is some implementations, and between about 10% and about 20% in some implementations.

In some implementations of the apparatus, the economy mode activation module is an acceleration economy mode activation module and the throttle input data includes throttle input rate of change values corresponding with rates of change of the position of the accelerator pedal. The defined limits can include a throttle input rate of change value upper limit and a throttle input rate of change lower limit. The throttle input rate of change value upper limit can be between about 50% and about 90% of a maximum throttle input rate of change value of the engine, and the throttle input rate of change value lower limit can be between about 50% and about 90% of a maximum throttle input rate of change value of the engine. In certain implementations, the throttle input rate of change value upper limit is about 75% of the maximum throttle input rate of change value of the engine, and the throttle input rate of change value lower limit is about 50% of the maximum throttle input rate of change value of the engine.

In some implementations of the apparatus, the throttle input data can further include throttle input values corresponding with positions of the accelerator pedal. As such, the defined limits may further include a throttle input value threshold. The economy mode activation module can be configured to control the fuel consumption of the internal combustion engine via the economy fuel map if the throttle input data falls within the defined limits for a predetermined amount of time and the throttle input values remain below the throttle input value threshold. In contrast, the standard fueling mode activation module is configured to control the fuel consumption of the internal combustion engine via the standard fuel map if at least one of the throttle input data does not fall within the defined limits for the predetermined amount of time and the throttle input values exceed the throttle input value threshold.

According to certain implementations, the economy fuel map and standard fuel map each includes respective fuel addition values for various operating conditions of the engine. The fuel addition values of the economy fuel map are lower than the fuel addition values of the standard fuel map for the same operating conditions of the engine.

According to some implementations, the economy mode activation module includes a steady state economy mode activation module, the throttle input data includes throttle input values corresponding with positions of the accelerator pedal, the defined limits include predetermined throttle input value limits, the economy fuel map includes a steady state economy fuel map, and the predetermined amount of time includes a first defined amount of time. The apparatus may further include an acceleration economy mode activation module that is configured to compare throttle input rate of change values with defined throttle input rate of change value limits. The throttle input rate of change values are controllable by the driver of the vehicle via positioning of the accelerator pedal over time, wherein the acceleration economy mode activation module is configured to control the fuel consumption of the internal combustion engine via an acceleration economy fuel map if the throttle input rate of change values fall within the throttle input rate of change value limits for a second defined amount of time. The standard fueling mode activation module is configured to control the fuel consumption of the internal combustion engine via the standard fuel map if the throttle input values do not fall within the defined throttle input value limits for the first defined amount of time and the throttle input rate of change values do not fall within the throttle input rate of change value limits for the second defined amount of time. The steady state economy fuel map and the acceleration economy fuel map can be the same or different.

According to another embodiment, an apparatus for controlling fuel consumption in an internal combustion engine of a vehicle having a driver-actuated accelerator pedal includes a controller with an economy fuel map and a standard fuel map. The apparatus also includes an operating mode determination module that is configured to switch control of a fueling operation of the engine between the economy fuel map and the standard fuel map based on a position of the accelerator pedal over time.

In some implementations of the apparatus, the economy fuel map is a steady state fuel map and the controller further includes an acceleration fuel map. The operating mode determination module is configured to switch control of the fueling operation of the engine between the steady state fuel map, acceleration fuel map, and standard fuel map based on whether the position of the accelerator pedal remains within first limits for a first amount of time and whether the rate of change of the position of the accelerator pedal remains within second limits for a second amount of time.

In certain implementations of the apparatus, control of the fueling operation of the engine is switchable between the economy and standard fuel maps via driver-controlled actuation of the accelerator pedal.

According to yet another embodiment, a method for controlling fuel consumption in an internal combustion engine of a vehicle having a driver-actuated accelerator pedal includes determining whether throttle input data falls within defined upper and lower limits for a defined period of time. The method also includes generating a fuel command for the engine based on an economy fuel map if the throttle input data falls within the defined upper and lower limits for the defined period of time. Additionally, the method includes generating a fuel command for the engine based on a standard fuel map if the throttle input data does not fall within the defined upper and lower limits for the defined period of time.

In one implementation of the method, the throttle input data includes a position of a throttle of the engine. In other implementations, the throttle input data includes a rate of change of the position of a throttle of the engine. The method may further include actuating the accelerator pedal to switch between generating the fuel command for the engine based on the economy fuel map and generating the fuel command for the engine based on the standard fuel map.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
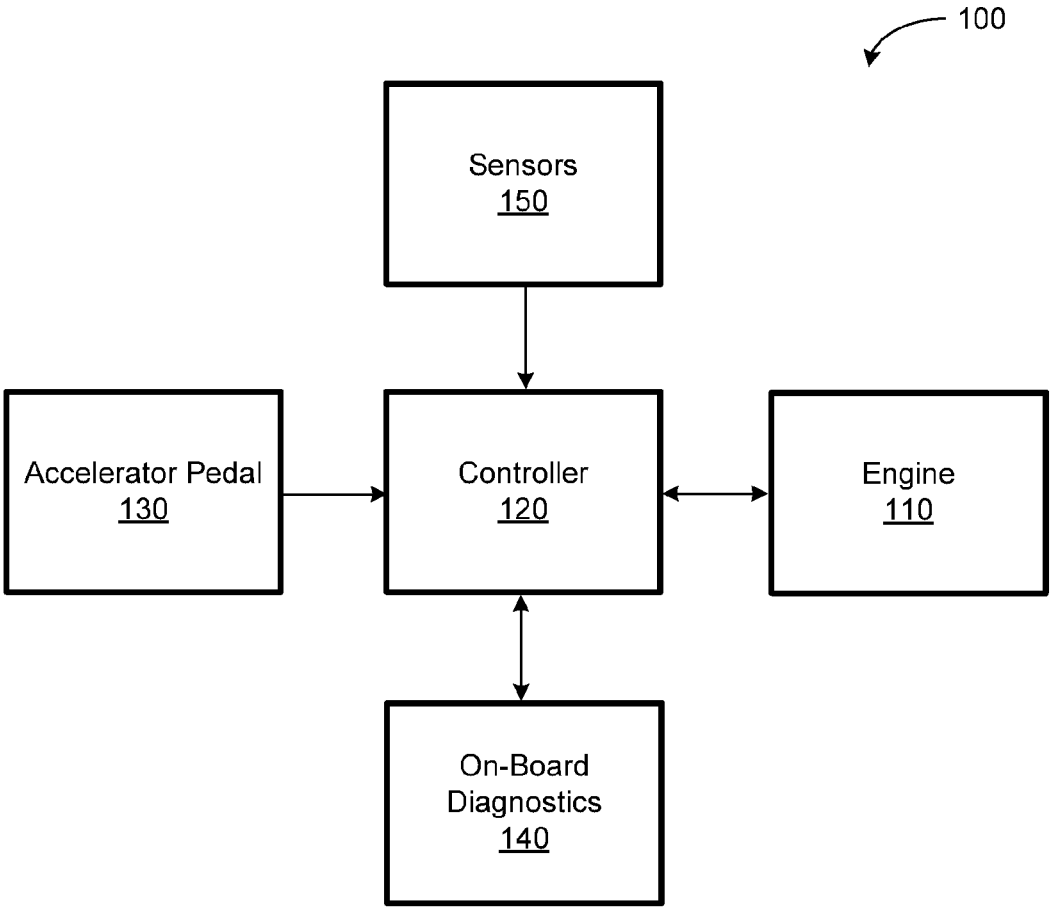
FIG. 1 is a schematic block diagram of an internal combustion engine system according to one representative embodiment.

According to one embodiment depicted in FIG. 1, an internal combustion engine system 100 includes an internal combustion engine 110 powered by a fuel. Although not shown, the engine system 100 may be placed within or form part of a vehicle and be configured to operate and propel the vehicle. The engine 110 may be a diesel-powered engine, a gasoline-powered engine, alternate-fuel-powered engine, or hybrid. The engine 110 generates power by combusting a fuel and air mixture within combustion chambers housed by the engine. The combustion of the mixture drives linearly-actuated or rotary-type pistons. The linear or rotational motion of the pistons rotates a driveshaft that transfers power to a drivetrain of a vehicle to move the vehicle. The amount of power generated by the engine 110 is largely dependent upon the amount of fuel added or injected into the combustion chambers. For example, the more fuel added to and combusted in the combustion chambers, generally the higher the power generated and fuel consumed by the engine. The amount of fuel added to the combustion chambers is dependent upon a variety of operating conditions 121, such as engine speed, engine load, vehicle speed, air intake characteristics, pressure, and temperature.

Generally, the amount of fuel to be added to the combustion chambers is obtained from a predetermined fuel map or maps storing fuel addition values compared to operating condition values 121. For example, in one basic implementation, the fuel map includes fuel addition values compared with engine speed and engine load values. Accordingly, in such an implementation, the amount of fuel to be added to the combustion chambers is the fuel addition value corresponding with the current engine speed and desired or required engine load. In other implementations, in addition to the engine speed and engine load values, the fuel map also includes one or more additional current operating condition values, such as vehicle speed values, current air intake characteristics values (e.g., air intake mass flow values, are intake mass concentration values, etc.), current pressure values (e.g., air intake pressure, ambient air pressure, exhaust pressure, etc.), and current temperature values (e.g., air intake temperature, ambient air temperature, exhaust temperature, etc.). Accordingly, in such other implementations, the amount of fuel to be added to the combustion chambers is the fuel addition value corresponding with the current engine speed and desired engine load, and the one or more additional operating condition values at the current engine speed and desired engine load.

The fuel map for an internal combustion engine of a vehicle is typically stored in the vehicle's electronic control module (ECM) or controller. In the illustrated embodiment, the controller 120 of the system 100 stores at least two fuel maps, for example, an economy fuel map and a standard fuel map, as will be described in more detail below. The controller 120 communicates with and/or receives communication from various components of the system 100, including the engine 110, an accelerator pedal 130, on-board diagnostics 140, various sensors 150 (which can include virtual and/or physical sensors). In some implementations, the controller 120 also communicates with other sensors and actuators according to the hardware of the specific configuration of the system 100. Generally, the controller 120 controls the operation of the engine system 100 and associated sub-systems, such as the engine 110 and on-board diagnostics 140. The controller 120 is depicted in FIG. 1 as a single physical unit, but can include two or more physically separated units or components in some embodiments if desired. In certain embodiments, the controller 120 receives multiple inputs, processes the inputs, and transmits multiple outputs. The multiple inputs may include sensed measurements from the sensors and various user inputs. The inputs are processed by the controller 120 using various algorithms, stored data, and other inputs to update the stored data and/or generate output values. The generated output values and/or commands are transmitted to other components of the controller and/or to one or more elements of the engine system 100 to control the system to achieve desired results, and more specifically, achieve desired fuel consumption characteristics.

Figure 2:
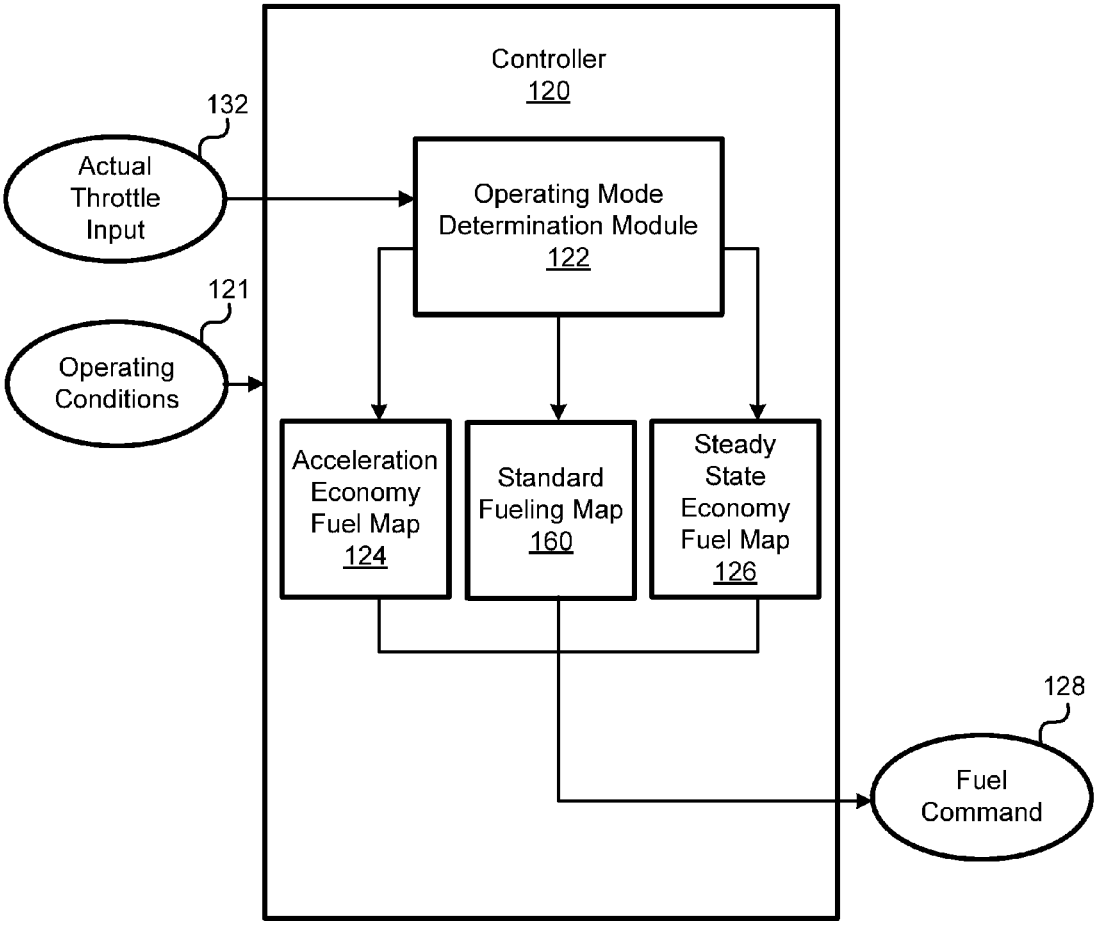
FIG. 2 is a schematic block diagram of a controller of an internal combustion engine system according to one embodiment.
Figure 3:
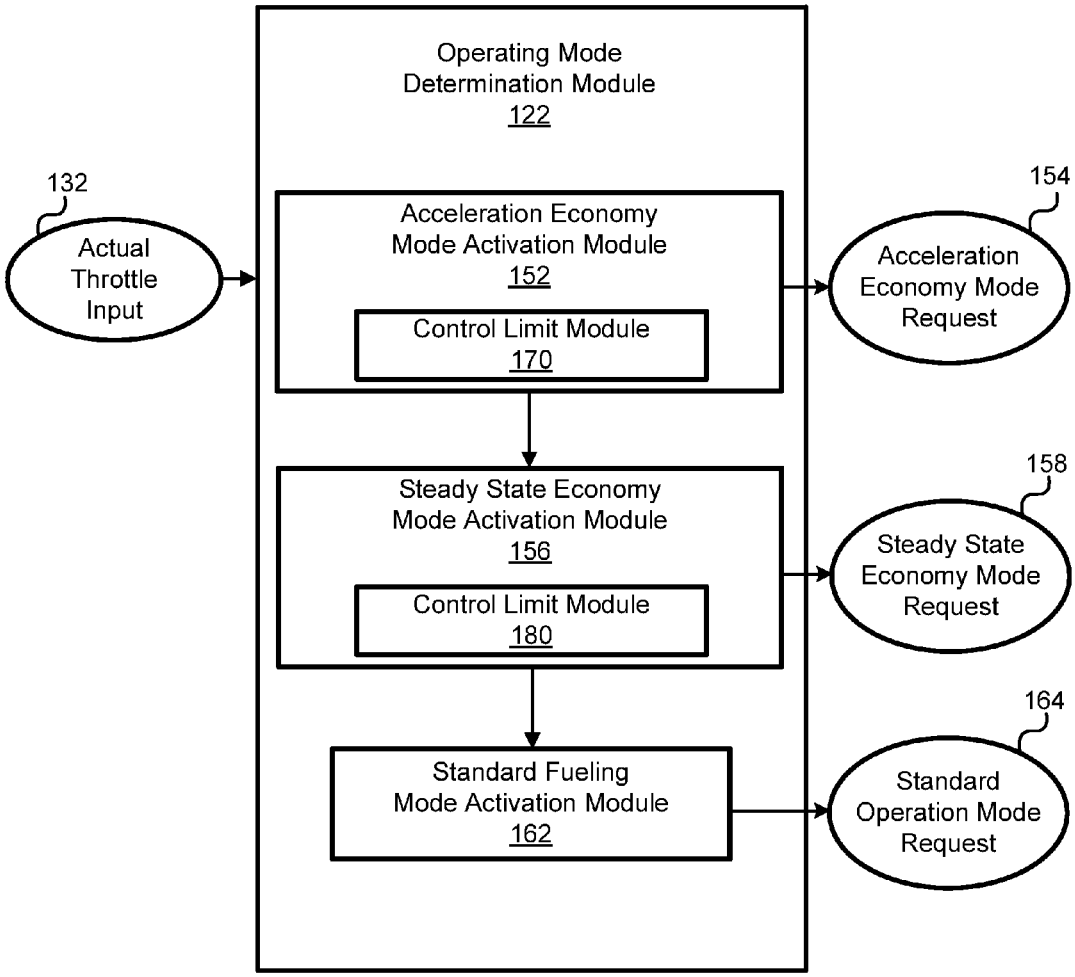
FIG. 3 is a schematic block diagram of an operating mode determination module of the controller of FIG. 1 according to one embodiment.

The controller 120 includes various modules and stores information for controlling the operation of the engine system 100. For example, as shown in FIGS. 2 and 3, the controller 120 includes an operating mode determination module 122, an acceleration economy mode activation module 152, a steady state economy mode activation module 156, and a standard fueling mode activation module 162. Additionally, the controller 120 includes an acceleration economy fuel map 124, a steady state economy fuel map 126, and a standard fuel map 160. Generally, the modules 122, 152, 156, 162 and fuel maps 124, 126, 160 of the controller 120 cooperate to achieve a desired fuel command representing a desired amount of fuel to be added to the combustion chambers of the engine 110 to power the engine.

The accelerator pedal 130 of the engine system 100 receives throttle input from a driver of the vehicle in which the engine system is housed, and communicates the throttle input to the controller 120. The throttle input is received from the driver via the driver's positioning of the accelerator pedal 130, which can be a foot pedal, hand pedal, or other type of acceleration input device. More specifically, the position of the accelerator pedal 130 of the vehicle is directly proportional to the position of a throttle intake valve that regulates the flow rate of air into the combustion chambers. For example, the more the accelerator pedal 130 is depressed, the more open the position of the throttle intake valve and the greater the flow rate of air into the combustion chambers. In contrast, the less the accelerator pedal 130 is depressed (e.g., the more the accelerator pedal 130 is released), the less open the position of the throttle intake valve and the lower the flow rate of air into the combustion chambers.

In some implementations, the accelerator pedal 130 can be mechanically coupled to the throttle intake valve. However, more commonly, the accelerator pedal 130 is electronically coupled to the throttle intake valve via one or more accelerator pedal position sensors (not shown), electrical wiring, one or more modules, and one or more separately-driven actuators. For example, in one implementation, the accelerator pedal 130 includes a position sensor that transmits the position of the accelerator pedal to the controller 120 and the controller generates a throttle input based on the position of the accelerator pedal, which is transmitted to the throttle intake valve to actuate the valve accordingly. Whether the coupling is mechanical and/or electronic, the driver-controlled position of the accelerator pedal 130 and associated position of the throttle intake valve is utilized by the controller 120 to generate a fueling command for the engine as will be described in more detail below.

The on-board diagnostics 140 includes components and modules configured to provide self-diagnosing and reporting capability. Additionally, the on-board diagnostics 140 can include user accessible interfaces that allow a user to access various operating conditions and performance parameters of the engine system 100, as well as to provide input for controlling the operating conditions and performance parameters. In one particular embodiment, the on-board diagnostics 140 includes a fuel consumption input interface, such as a mechanical or graphical button, knob, switch, etc., that is accessible by a user to switch between different fuel consumption modes or disable certain fuel consumption modes if desired. In another embodiment, the on-board diagnostics 140 includes an indicator interface, such as a light, graphic, or other notification, that alerts a user of the activation of a particular fuel consumption mode. On-board alerts signaling the fuel consumption mode can aid a driver in learning how to maintain the accelerator pedal in a proper position and/or rate of change to place operation of the engine within a desired mode.

The sensors 150 include one or more sensing devices configured to sense (e.g., detect, measure, etc.) at least one operating condition and report the sensed operating condition to the controller 120. In some embodiments, the sensors 150 include one or more of intake air mass flow sensors, pressure sensors, temperature sensors, engine speed sensors, vehicle speed sensors, exhaust mass concentration sensors, and the like. The sensors 150 can include physical sensors or virtual sensors.

Referring back to FIG. 2, in one embodiment, the operating mode determination module 122 of the controller 120 selects a fuel consumption mode of the engine 110. Generally, the operating mode determination module 122 receives an actual throttle input 132 based on the driver-controlled position of the accelerator pedal 130. Generally, the actual throttle input 132 represents the throttle valve position (e.g., intake air characteristics) demanded by the actual position of the accelerator pedal 130 under normal operating conditions. Accordingly, the actual throttle input 132 is directly proportional to the actual position of the accelerator pedal 130 as controlled by the driver. Based on the actual throttle input 132, the operating mode determination module 122 selects the fuel consumption mode of the engine 110.

As shown in FIG. 3, in one embodiment, based at least partially on the actual throttle input 132, the operating mode determination module 156 issues one of an acceleration economy mode request 154, a steady state economy mode request 158, and a standard operation mode request 164, respectively. Depending on which one of the requests 154, 158, 164 is issued by the module 122, one of an acceleration economy fuel map 124, steady state economy fuel map 126, and standard fuel map 160, respectively, is used to determine the amount of fuel to be added to the combustion chambers of the engine 110 and issue a corresponding fuel command 128. For example, if the request issued by the operating mode determination module 122 is the acceleration economy mode request 154, then the controller 120 utilizes the acceleration economy fuel map 124 to determine and issue the fuel command 128. Similarly, if the request issued by the operating mode determination module 122 is the steady state economy mode request 158, then the controller 120 utilizes the steady state economy fuel map 126 to determine and issue the fuel command 128. Finally, should the operating mode determination module 122 issue the standard operation mode request 164, then the controller 120 utilizes the standard fuel map 160 to determine and issue the fuel command 128.

The values of the fuel maps 124, 126, 160 are predetermined or preset based on factory testing, calculations, and/or user needs (e.g., predicted vehicle driving conditions, predicted loads, fuel costs, etc.). Generally, the standard fuel map 160 is tuned to provide fuel injection values at given operating conditions based on a substantially equal weighting of performance and fuel economy. In contrast, the economy fuel maps 124, 126 are tuned to provide fuel injection values at the given operating conditions based on weighing fuel economy over performance. Accordingly, the fuel injection values at the given operating conditions in the economy fuel maps 124, 126 are generally lower than the fuel injection values at the same operating conditions in the standard fuel map 160. In other words, the economy fuel maps 124, 126 are tuned to promote fuel economy (e.g., a reduction in fuel consumption, a savings of fuel, etc.) at the expense of performance.

Generally, the acceleration economy fuel map 124 is tuned to reduce fuel consumption while the speed of the engine 110 is increasing (e.g., accelerating). Similarly, the steady state economy fuel map 126 is tuned to reduce fuel consumption while the speed of the engine 110 is held substantially constant (e.g., operating in a steady state). In some implementations, the acceleration economy fuel map 124 includes fuel injection values different than the fuel injection values of the steady state economy fuel map 126 at the same operating conditions. For example, in one specific implementation, the fuel injection values in the acceleration economy fuel map 124 are generally higher than the fuel injection values in the steady state economy fuel map 126 because, for certain applications, performance during acceleration is slightly more important than during steady state conditions. Alternatively, in another specific implementation, the fuel injection values in the acceleration economy fuel map 124 are generally lower than the fuel injection values in the steady state economy fuel map 126 because, for certain applications, performance during steady state conditions is slightly more important than during acceleration. However, in yet other implementations, fuel injection values in the acceleration economy fuel map 124 and steady state economy fuel map 126 are the same at the same operating conditions such that the controller effectively has a single economy fuel map for both acceleration and steady state economy modes.

The one request of the three requests 154, 158, 164 issued by the operating mode determination module 156 is dependent on which fuel consumption mode best accommodates lower fuel consumption objectives in view of the past and/or current characteristics of the actual throttle input 132. To assist in determining which fuel consumption mode the engine should operate under, the operating mode determination module 122 includes the acceleration economy mode activation module 152 and the steady state economy mode activation module 156. Each module 152, 156 compares actual throttle input 132 data with predetermined thresholds or limits and issues the acceleration economy mode request 154 and steady state economy mode request 158, respectively, if the data meets certain conditions defined by the thresholds or limits. As configured in the illustrated embodiment, the actual throttle input data 132 will not meet both the conditions defined by the acceleration economy mode activation module 152 and the conditions defined by the steady state economy mode activation module 156. However, it is possible that the actual throttle input data 132 does not meet either of the conditions defined by the modules 152, 156, in which case the request issued by the operating mode determination module 122 is the standard operation mode request 164 generated by the standard fueling mode activation module 162.

Figure 4:
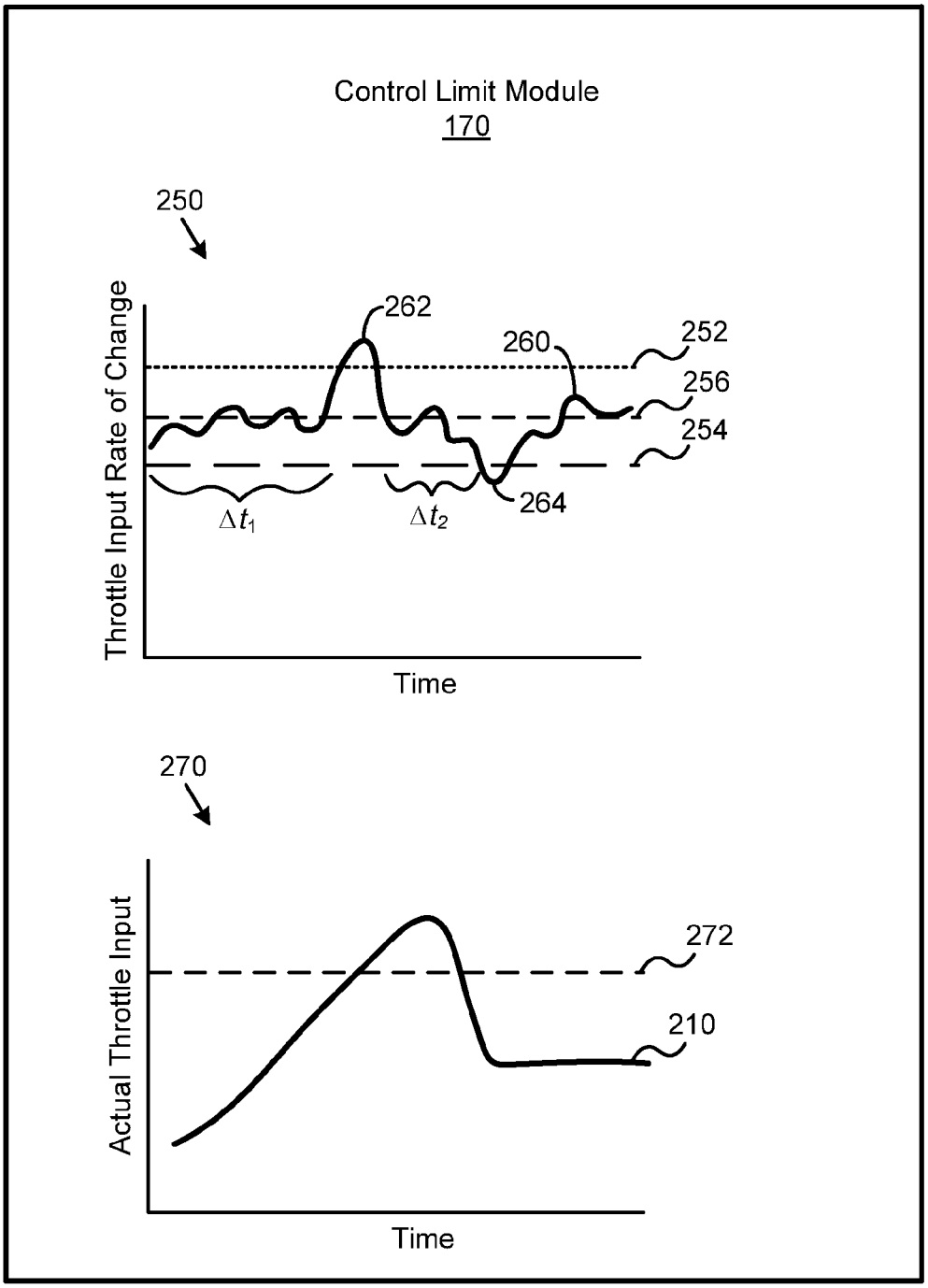
FIG. 4 is a schematic block diagram of a control limit module of an acceleration economy mode activation module of a controller according to one embodiment.

Referring to FIGS. 3 and 4, the acceleration economy mode activation module 152 of the illustrated embodiment includes a control limit module 170 that compares actual throttle input 132 data with two charts 250, 270 each having predetermined (e.g., precalibrated) throttle input data limits and/or thresholds to determine whether an acceleration economy mode request 154 should be issued (i.e., whether the engine 110 should be operated in an acceleration economy mode). The control limit module 170 receives actual throttle input 132 and stores the input values over time. According to the differences of the stored input values over time, the control limit module 170 calculates the rate of change of the throttle input over time and compares the throttle input rate of change to predetermined upper and lower limits 252, 254. For example, as shown in the chart 250, a plot 260 of stored throttle input rate of change values over time is shown, and compared against the upper and lower limits 252, 254. Generally, if the throttle input rate of change is within the upper and lower limits 252, 254 for a predetermined threshold amount of time $t_{accel}$, then the acceleration economy mode activation module 152 issues the acceleration economy mode request 154.

The predetermined time threshold $t_{accel}$ is selected to be long enough to filter out inadvertent or relatively quick acceleration bursts, and to consider only the more typical relatively longer and more steady acceleration operating periods (e.g., accelerating from a stop). The plot of throttle input rate of change values 260 shown in FIG. 4 is merely exemplary to show the operation of the control limit module 170 according to one embodiment. But, for the acceleration patterns exemplified in the plot of values 260, the acceleration economy mode activation module 152 issues the acceleration economy mode request 154 during the time period $\Delta t_1$ that the throttle input rates of change 260 are within the upper and lower limits 252, 254 (assuming $\Delta t_1$ is greater than the predetermined time threshold $t_{accel}$). However, assuming $\Delta t_2$ is less than the predetermined threshold $t_{accel}$, the module 152 does not issue the request 154 during the time period $\Delta t_2$ despite the throttle input rate of change 260 being within the limits 252, 254 during the time period $\Delta t_2$. Additionally, the module 152 does not issue the request 154 while the throttle input rate of change 262 is greater than the upper limit 252 (e.g., when drastic engine/vehicle acceleration is desired) or the change 264 is less than the lower limit 254 (e.g., when engine/vehicle acceleration is low enough that fuel savings is less of an issue).

The chart 250 also shows a target acceleration or throttle input rate of change value 256 exactly or substantially between the upper and lower limits 252, 254. The target acceleration value 256 can be communicated to a driver in such a way that the driver may know how or may strive to keep the acceleration of the engine 110 around the target value 256 should the driver wish to operate in the fuel economy mode during acceleration. In this manner, a driver may be instructed or teach himself how to accelerate or actuate the accelerator pedal 130 for achieving improved fuel economy over performance. However, in certain situations, such as emergency situations, or when passing a vehicle, the driver may desire performance over economy for a shortened period of time, and simply actuate (e.g., depress) the accelerator pedal 130 in a manner to effectuate a rate of change of the throttle input sufficiently high that the operation of the engine is taken out of the acceleration economy mode (e.g., no request 154 is issued) and into the standard fuel consumption mode.

The upper and lower limits 252, 254 are predetermined based on any of various factors, such as, for example, the particular application for which the engine is used, the gross vehicle weight (GVW) of the vehicle, the engine's rating. For example, the more the vehicle is driven under city conditions, the higher the upper and lower limits. As another example, the higher the torque capacity of the engine, the wider the difference between the upper and lower limits. In some implementations, the upper and lower limits 252, 254 are about 25% and about 75% of the maximum acceleration of the engine/vehicle, and the target acceleration value 256 is about 50% of the maximum acceleration of the engine/vehicle. In some embodiments, the upper and lower limits 252, 254 can be determined by physical testing of the vehicle in view of the particular application for which the vehicle will be used.

Alternatively, operation of the engine 110 in the acceleration economy mode is not initiated, or the engine is taken out of the acceleration economy mode, if the actual throttle input 210 exceeds a predetermined threshold 272 as shown in chart 270. Accordingly, regardless of the rate of change 260 of the actual throttle input, the acceleration economy mode activation module 152 does not issue the acceleration economy mode request 154 to operate the engine according to an economy fuel map should the actual throttle input exceed the threshold 272 (e.g., the accelerator pedal 130 be depressed beyond a position threshold). This additional filter is provided to ensure performance when performance is likely needed, such as when the throttle position is nearly wide open for maximum power (e.g., when accelerating up a hill). The predetermined threshold 272 can be the same or different than (e.g., higher than) the upper limit 202 (including the upper limit 252 in some implementations) of the control limit module 180 as will be explained in more detail below. In some implementations, the throttle position threshold 272 is between about 75% and 100% of fully open or maximum air intake flow. In one implementation, the throttle position threshold 272 is about 90% of fully open.

Based on the foregoing, a driver can initiate operation of the engine 110 in an economy fueling mode during acceleration of the engine by keeping the change in position of the accelerator pedal 130 (which corresponds with the rate of change of the throttle input) within prescribed limits and keeping the position of the accelerator pedal 130 below a position threshold associated with a throttle input threshold. Similarly, a driver can switch from an acceleration economy fueling mode to the standard fueling mode (e.g., take the engine operation out of economy fueling mode during acceleration) by changing the position of the accelerator pedal 130 at a ramp rate above or below the prescribed limits or changing the position of the accelerator pedal 130 to a position above the threshold 272. In some implementations, however, because less fuel is needed for lower acceleration rates and performance is less of a priority at lower acceleration rates, operation of the engine 110 may be maintained in the acceleration economy fueling mode even if the ramp rate of the throttle input is reduced to a rate below the lower threshold 254.

Even if the engine 110 is not accelerating, the engine can still be operated in an economy fueling mode during steady state operation of the engine within prescribed limits. For example, referring to FIGS. 3 and 5, the steady state economy mode activation module 156 of the illustrated embodiment includes a control limit module 180 that compares actual throttle input 132 data with a chart 200 that has predetermined throttle input data limits to determine whether a steady state economy mode request 158 should be issued (i.e., whether the engine 110 should be operated in a steady state economy mode). The control limit module 180 receives actual throttle input 132 and stores the input values over time. The stored throttle input 132 values are compared to predetermined upper and lower limits 202, 204. For example, as shown in the chart 200, a plot 210 of stored throttle input 132 values over time is shown, and compared against the upper and lower limits 202, 204. Generally, if the throttle input values are within the upper and lower limits 202, 204 for a predetermined threshold amount of time $t_{ss}$, then the steady state economy mode activation module 156 issues the steady state economy mode request 158.

The upper and lower limits 202, 204 are predetermined in that they are based on a predetermined percentage difference from an average throttle input 206. For example, based on any of various factors and preferences, such as the use of the vehicle, the driving characteristics of the driver, the desired fuel economy of the driver and/or owner of the vehicle, the experience of the driver, etc., a desired deviation from an average throttle input 206 in terms of a percentage can be preselected. More specifically, the upper limit 202 can be a throttle input that is a predetermined percentage greater than the average throttle input or target 206. Similarly, the lower limit 204 can be a throttle input that is a predetermined percentage lower than the average throttle input or target 206. Accordingly, although the upper and lower limits 202, 204 may vary based on the actual position of the throttle, they are nevertheless considered to be a predetermined percentage greater and less than the average throttle position 206, respectively.

For example, in one implementation, the upper and lower limits 202, 204 may be set to be plus/minus 10% of the average throttle input or target 206. Accordingly, the throttle input range for keeping the operation of the engine in the steady state economy mode is 20%. In other words, as long as the actual throttle input remains within a 20% range for a predetermined time threshold, then the engine will be operated in the steady state economy mode and the average throttle input 206 or target is calculated as the average value of the throttle input during the predetermined time threshold and the upper and lower limits 202, 204 are set accordingly (i.e., 10% above and 10% below the average throttle input 206). Of course other percentage ranges can be used, such as plus/minus 5% or plus/minus 20%. Generally, for more control over which operating mode is selected for operation, and for more experience drivers in most cases, the percentage range is smaller than for less experienced drivers or owners who do not want to give their drivers the ability to precisely control which operating mode is selected.

Initially, for an operator to set operation of the engine in the steady state economy mode, he/she must maintain the throttle input (e.g., position) steady enough to remain within a predetermined percentage range for the predetermined time threshold $t_{ss}$ as discussed above. In other words, as long as the actual throttle input does not vary by more than the predetermined percentage range for the predetermined time threshold $t_{ss}$, operation of the engine in the steady state economy mode is activated. The chart 200 also shows an average or target throttle input value 206 exactly or substantially between the upper and lower limits 202, 204. The average target throttle input value 206 is the average throttle input value during the predetermined time threshold $t_{ss}$ (assuming the actual throttle input remains within the predetermined percentage range for the predetermined time threshold). Once the average target throttle input value 206 is determined, and the steady state economy mode is activated, the upper and lower limits 202, 204, are set to be the predetermined percentage difference from the average target throttle input value 206. For example, if the predetermined percentage range is 20%, the upper limit 202 is set to be 10% higher than the average target throttle input value 206, and the lower limit 204 is set to be 10% lower than the average target throttle input value. Then, as long as the actual throttle input does not exceed the upper and lower limits 202, 204, operation of the engine will remain in the steady state economy mode.

The predetermined time threshold $t_{ss}$ is selected to be long enough to stabilize vehicle speed. More specifically, the predetermined time threshold $t_{ss}$ is selected to filter out inadvertent lulls during acceleration periods, and to consider only the more typical relatively longer and more constant steady state operating periods (e.g., cruising at highway speeds). Further, the sampling rate of the stored actual throttle inputs is set to correspond with the predetermined time threshold $t_{ss}$ such that enough data points are stored during the time threshold that an accurate throttle input average 206 can be determined. In one implementation, for example, the predetermined time threshold $t_{ss}$ is 5 seconds, and the sampling rate is 5 times per second. The predetermined time threshold $t_{ss}$ can be fixed or may be adjustable should driving conditions or driving preferences change.

Figure 5:
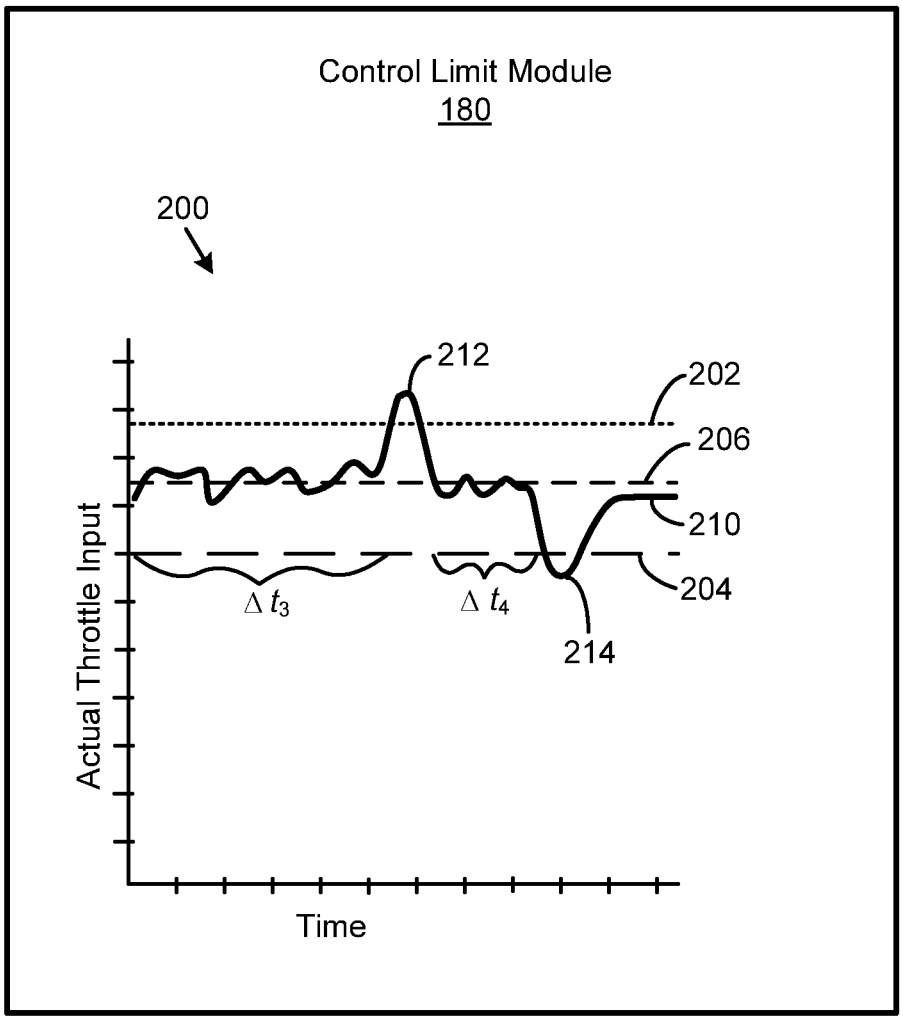
FIG. 5 is a schematic block diagram of a control limit module of a steady state economy mode activation module of a controller according to one embodiment.

The plot 200 of throttle input values 210 shown in FIG. 5 is merely exemplary to show the operation of the control limit module 180 according to one embodiment. But, for the acceleration patterns exemplified in the plot of values 210, the steady state economy mode activation module 156 issues the steady state economy mode request 158 during the time period $\Delta t_3$ that the throttle input values 210 are within upper and lower limits 202, 204 set according to a predetermined percentage range (assuming $\Delta t_3$ is greater than the predetermined time threshold $t_{ss}$). But, because the throttle input at 212 is greater than the upper limit 202, operation of the engine in the steady state economy mode is stopped. Further, assuming the subsequent time period $\Delta t_4$ is less than the predetermined threshold $t_{ss}$, the module 156 does not issue the request 158 during the time period $\Delta t_4$ to reinstitute the steady state economy mode despite the throttle input value 210 being within the limits 202, 204 during the time period $\Delta t_4$. Additionally, the module 156 does not issue the request 158 while the throttle input values 212 are greater than the upper limit 202 (e.g., when very high engine/vehicle speeds are reached) or the values 214 are less than the lower limit 204 (e.g., when the engine/vehicle speed drops low enough that fuel savings is less of an issue). If the actual throttle value becomes higher than or lower than the upper and lower limits 202, 204, not only is the engine taken out of the steady state fuel economy mode, but the average throttle value 206 is effectively deleted and reset only when the conditions for operating the engine in the steady state operating mode are again met.

After the upper and lower limits 202, 204 are set, should the driver slowly modulate the position of the throttle input from the previously set average throttle input value 206, but remain within the previously set upper and lower limits 202, 204 for another period at least at long as the predetermined time threshold $t_{ss}$, operation of the engine will remain in the steady state economy mode, but a new average throttle input value 206 is calculated, and new upper and lower limits 202, 204 are set based on the new average throttle input value. In this manner, the average or target throttle input value 206, and the associated upper and lower limits 202, 204 are variable or adjustable by the driver as desired to provide the driver with the ability to slowly adjust the vehicle speed, but remain in the steady state economy mode. Only when the driver quickly and drastically opens or closes the throttle to a position outside of the upper and lower limits 202, 204 will the vehicle switch out of operation in the steady state economy mode.

The target throttle input value 206 can be communicated to a driver in such a way that the driver may know how or may strive to keep the position of the accelerator pedal 130 and the throttle input 132 of the engine 110 around the target value 206 should the driver wish to operate in the fuel economy mode during steady state conditions. In this manner, a driver may be instructed or teach himself how to maintain a position of the accelerator pedal 130 for achieving improved fuel economy over performance. However, in certain situations, such as emergency situations, or when passing a vehicle, the driver may desire performance over economy for a shortened period of time, and simply actuate (e.g., depress) the accelerator pedal 130 in a manner to adjust the throttle input 132 above the upper limit 202 such that operation of the engine is taken out of the acceleration economy mode (e.g., no request 158 is issued) and into the standard fuel consumption mode.

The upper and lower limits 202, 204 are predetermined based on various factors, such as those discussed above in relation to upper and lower limits 252, 254. For example, the more the vehicle is driven under highway conditions, the lower the predetermined percent difference between the upper and lower limits. In some implementations, the percent difference between the upper and lower limits 202, 204 is between about 10% and about 75%. In other implementations, the percent difference is between about 10% and about 20%.

Preferably, the upper and lower limits 202, 204, and the predetermined period of time $t_{ss}$, are selected in coordination with the upper and lower limits 252, 254, and the predetermined period of time $t_{accel}$ to ensure that the conditions associated with activation of the steady state economy mode do not overlap the conditions associated with activation of the acceleration economy mode. In other words, in the illustrated embodiments, the operating mode determination module 122 is configured to activate only one of the steady state and acceleration economy modes at a time. For example, the upper and lower limits 252, 254 are high enough, and the period of time $t_{accel}$ is long enough, that any acceleration occurring while the throttle input is within the upper and lower limits 202, 204 would not be high enough or long enough to trigger generation of an acceleration economy mode request 154 without the throttle input falling outside the upper and lower limits 202, 204. Similarly, in certain embodiments, the upper and lower limits 202, 204 are low enough, and the period of time $t_{ss}$ is long enough, that any throttle position occurring while the acceleration is within the upper and lower limits 252, 254 would not be low enough or maintained long enough to trigger generation of a steady state economy mode request 158 without the acceleration falling outside the upper and lower limits 252, 254. Alternatively, in other embodiments, conditions for generating both acceleration and steady state economy mode requests 154, 158 may overlap, in which case, a weighting algorithm or user setting may select which of the requests (e.g., economy modes) is utilized to operating the fueling of the engine.

Based on the foregoing, a driver can initiate operation of the engine 110 in an economy fueling mode during steady state or cruising conditions by maintaining the accelerator pedal 130 in a relatively constant position within prescribed limits. Similarly, a driver can switch from a steady state economy fueling mode to the standard fueling mode by depressing or releasing the accelerator pedal 130 into a position that is associated with a throttle input value above or below the prescribed limits. In some implementations, however, because less fuel is needed for lower throttle inputs and performance is less of a priority at lower throttle inputs, operation of the engine 110 may be maintained in the steady state economy fueling mode even if the throttle input drops below the lower threshold 204.

Further, in view of the above, a driver can switch directly between operation in the acceleration economy fueling mode and operation in the steady state economy fueling mode by applying the above-discussed principles. For example, from operation in the acceleration economy fueling mode, a driver can simply slow down or stop the rate of change of the position of the accelerator pedal 130 when the position of the pedal is within the steady state upper and lower limits 202, 204, and maintain the position of the pedal within the limits for a time greater than the time threshold $t_{ss}$, to switch directly to the steady state economy fueling mode. Similarly, from operation in the steady state economy fueling mode, a driver can simply depress the accelerator pedal 130 at a rate within the upper and lower limits 252, 254, and maintain the rate of change of the accelerator position for a time greater than the time threshold $t_{accel}$, as well as keep the position of the accelerator pedal 130 below the threshold 272, to switch directly to the acceleration economy fueling mode.

In some implementations, the control limits of the engine system 100, such as the acceleration upper and lower limits 252, 254, the steady state upper and lower limits 202, 204, and the throttle input threshold 272, are statically determined and set prior to or between uses. For example, the factory may determine and set the control limits prior to distribution to an end-user. After receipt of the vehicle, whether prior to or between uses, the end-user (which can be a vehicle dealer) may tune the factory-set control limits based on its particular needs (e.g., additional or less fuel consumption). In one implementation, the end-user can tune the control limits of the engine system 100 based on operating conditions data (e.g., the rate of change in the throttle input over time) stored on a vehicle's ECM after some usage of the vehicle. The adjustment of the control limits based on previous operating conditions can be configured to be done manually or automatically. For example, the end-user may elect to manually tune the control limits periodically or in view of changing market conditions. Alternatively, the operating mode determination module 122 may be configured to automatically re-tune the control limits periodically, such as after a certain mileage, or continuously (e.g., dynamically) while the vehicle is in use.

Although in the illustrated embodiments, the system 100 is switchable between three fueling modes (e.g., a standard fueling mode, an acceleration economy fueling mode, and steady state economy fueling mode) each with a corresponding fuel map, in other embodiments, the system can be switchable between fewer or more than three fueling modes.

For example, in one embodiment, the system 100 may be switchable between only two fueling modes, such as a standard fueling mode and only one of the acceleration and steady state economy fueling modes. In other words, in view of the illustrated embodiment, the controller 120 would only have one of the economy fuel maps 124, 126 and only one of the activation modules 152, 156 depending on which one of the economy fueling modes is included in the system. In such an embodiment, a user may be more concerned with reducing fuel consumption for one of accelerating and steady state operations than the other. According to one implementation associated with vehicles experiencing frequent start and stops, such as urban delivery vehicles, the system 100 may include a standard fueling mode and only an acceleration economy fueling mode as described above. In contrast, in another implementation associated with higher speed, long-distance vehicles, such as semi-trucks, the system 100 may include a standard fueling mode and only a steady state economy fueling mode as described above.

Additionally, in yet some embodiments, and for more precise control over the reduction of fuel consumption, the system 100 may be switchable between more than three modes, such as a standard fueling mode, and multiple acceleration economy fueling modes and/or multiple steady state economy fueling modes each with a distinct fueling map. For example, the system 100 may include multiple acceleration economy fueling modes with each mode associated with a separate economy fueling map and activated via acceleration operations between respective different upper and lower acceleration ranges. Moreover, in some embodiments, the system 100 may include multiple steady state economy fueling modes with each mode associated with a separate economy fueling map and activated via throttle input values between respective different upper and lower ranges.

Figure 6:
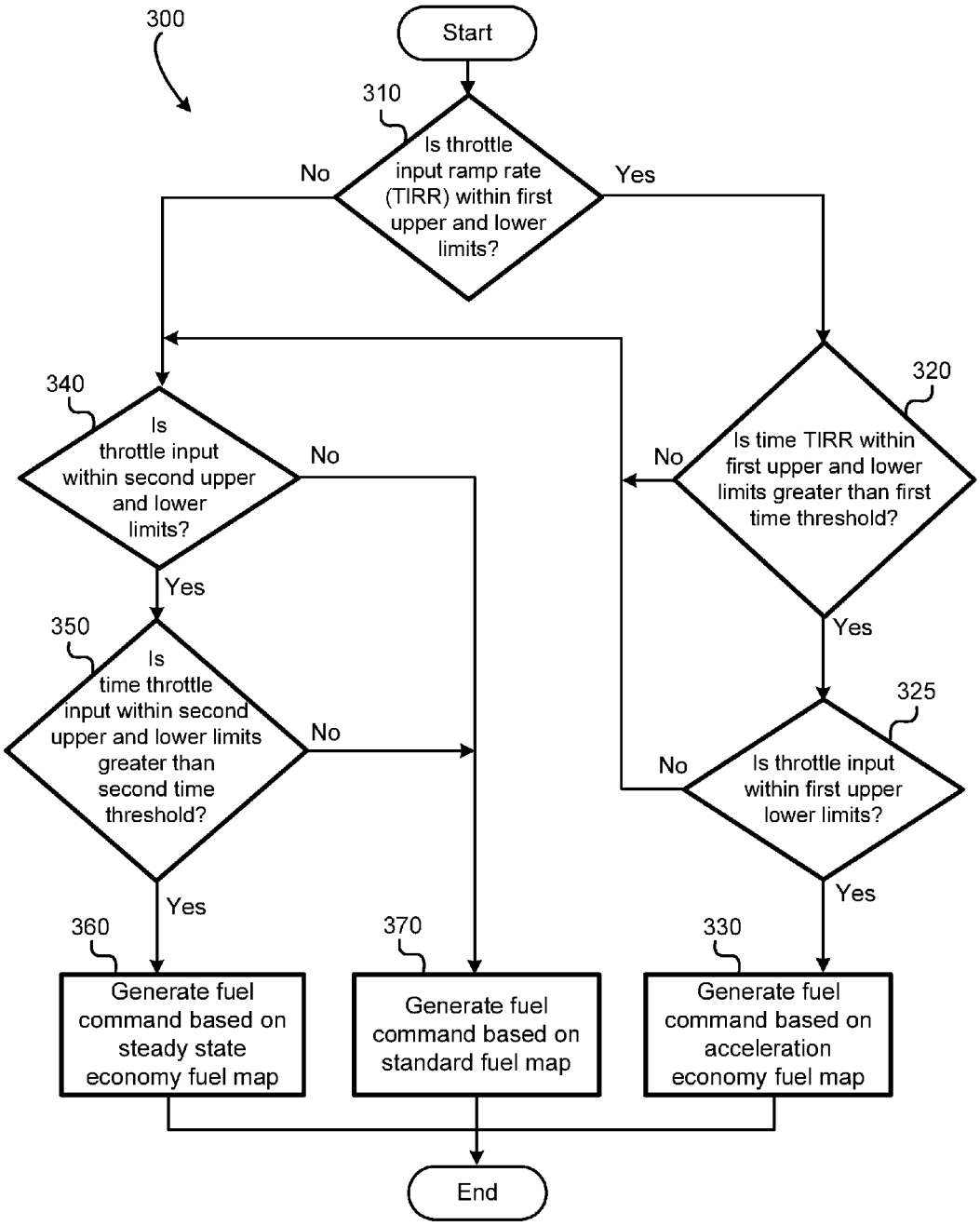
FIG. 6 is a schematic flow chart diagram depicting a method for controlling the fuel consumption of an internal combustion engine according to one embodiment.

Referring to FIG. 6, and according to one embodiment, a method 300 for controlling fuel consumption includes determining at 310 whether a throttle input ramp rate (TIRR) is within first upper and lower limits (e.g., upper and lower limits 252, 254). As discussed above, the first upper and lower limits can be predetermined and statically set, or predetermined and dynamically or statically adjustable based factors associated with driving preferences and operations. If the TIRR is within the first upper and lower limits, then the method 300 proceeds to determine at 320 whether the amount of time the TIRR is within the first upper and lower limits is greater than a first time threshold (e.g., $t_{accel}$). Should the amount of time the TIRR is within the first upper and lower limits be greater than the first time threshold, then the method proceeds to determine at 325 whether the throttle input is less than a first threshold (e.g., threshold 272). If the determination at 325 is answered affirmatively, then the method 300 generates the engine's fuel command at 330 based on an acceleration economy fuel map (e.g., acceleration economy fuel map 124) and the method ends. The fuel command is communicated to the fueling system of the engine 110 to add fuel to the engine according to the command.

Going back to step 310 of the method 300, if any one of the determinations 310, 320, 325 is answered in the negative, then the method 300 determines at 340 whether a throttle input is within second upper and lower limits (e.g., upper and lower limits 202, 204) or a predetermined percentage range. Should the throttle input be within the upper and lower limits, then the method 300 determines at 350 whether the throttle input has been within the upper and lower limits for greater than a second time threshold (e.g., $t_{ss}$). If the determination at 350 is answered in the affirmative, then the method 300 generates the engine's fuel command at 360 based on a steady state economy fuel map (e.g., steady state economy fuel map 126) and the method ends.

Generally, if conditions dictate the engine's fuel command not be based on the acceleration steady state economy fuel map or steady state economy fuel map, which in some embodiments can be the same map, then the method 300 generates the engine's fuel command at 370 based on a standard fuel map (e.g., standard fuel map 160). More specifically, if either of the determinations 310, 320, 325 is answered negatively, and either of the determinations 340, 350 answered negatively, then the fuel command sent to the fueling system of the engine is obtained from a standard fuel map.

Although not shown, the steps of the method 300 can be reordered such that the steady state mode determinations 340, 350 are performed prior to the acceleration mode determinations 310, 320, 325 if desired. Moreover, in some embodiments of the method 300, one of the steady state mode determinations 340, 350 and acceleration mode determinations 310, 320, 325 may be omitted based on user preference, such as when saving fuel during steady state conditions or acceleration conditions, respectively, is not desirable or important.

The schematic flow chart diagrams and method schematic diagrams described above are generally set forth as logical flow chart diagrams. As such, the depicted order and labeled steps are indicative of representative embodiments. Other steps and methods may be conceived that are equivalent in function, logic, or effect to one or more steps, or portions thereof, of the methods illustrated in the schematic diagrams. Additionally, the format and symbols employed are provided to explain the logical steps of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of computer readable program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of computer readable program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the computer readable program code may be stored and/or propagated on in one or more computer readable medium(s).

The computer readable medium may be a tangible computer readable storage medium storing the computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing.

More specific examples of the computer readable medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. Computer readable program code embodied on a computer readable signal medium may be transmitted using any appropriate medium, including but not limited to wireless, wireline, optical fiber cable, Radio Frequency (RF), or the like, or any suitable combination of the foregoing In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on RAM storage device for execution by the processor.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The computer readable program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A controller for controlling fuel consumption in an internal combustion engine of a vehicle having a driver-actuated accelerator pedal, comprising:

an economy fueling mode activation module configured to receive a throttle input value and determine whether the throttle input value falls within defined limits, the throttle input value being controllable by a driver of the vehicle via positioning of the accelerator pedal, wherein the economy mode activation module is configured to activate an economy fueling mode in response to determining the throttle input value falls within the defined limits for a defined amount of time while the internal combustion engine is operating under a standard fueling mode, the economy fueling mode requiring less fuel consumption than the standard fueling mode, wherein the economy mode activation module is an acceleration economy mode activation module and the throttle input value corresponds with rates of change of the position of the accelerator pedal; and a standard fueling mode activation module configured to receive the throttle input value and determine whether the throttle input value falls within the defined limits, wherein the standard fueling mode activation module is configured to activate the standard fueling mode in response to determining the throttle input value does not fall within the defined limits for the defined amount of time while the internal combustion engine is operating under the economy fueling mode.

2. A controller for controlling fuel consumption in an internal combustion engine of a vehicle having a driver-actuated accelerator pedal, comprising:

an economy fueling mode activation module configured to receive a throttle input value representing a throttle valve position and determine whether the throttle input value falls within defined limits, the throttle input value being controllable by a driver of the vehicle via positioning of the accelerator pedal, wherein the economy mode activation module is configured to activate an economy fueling mode in response to determining the throttle input value falls within the defined limits for a defined amount of time while the internal combustion engine is operating under a standard fueling mode, the economy fueling mode requiring less fuel consumption than the standard fueling mode, wherein the economy mode activation module is a steady state economy mode activation module and the throttle input value comprises throttle input values corresponding with positions of the accelerator pedal; and a standard fueling mode activation module configured to receive the throttle input value and determine whether the throttle input value falls within the defined limits, wherein the standard fueling mode activation module is configured to activate the standard fueling mode in response to determining the throttle input value does not fall within the defined limits for the defined amount of time while the internal combustion engine is operating under the economy fueling mode, wherein the defined limits comprise a throttle input value upper limit and a throttle input value lower limit, and wherein a throttle input percent difference between the upper limit and lower limit is between about 10% and about 75%.

3. The controller of claim 2, wherein the throttle input percent difference is between about 10% and about 20%.

4. The controller of claim 1, wherein the defined limits comprise a throttle input rate of change value upper limit and a throttle input rate of change lower limit, and wherein the throttle input rate of change value upper limit is between about 50% and about 90% of a maximum throttle input rate of change value of the engine, and the throttle input rate of change value lower limit is between about 50% and about 90% of a maximum throttle input rate of change value of the engine.

5. The controller of claim 4, wherein the throttle input rate of change value upper limit is about 75% of the maximum throttle input rate of change value of the engine, and the throttle input rate of change value lower limit is about 50% of the maximum throttle input rate of change value of the engine.

6. The controller of claim 1, wherein the throttle input value further comprises throttle input values corresponding with positions of the accelerator pedal, wherein the defined limits further comprise a throttle input value threshold, and wherein the economy mode activation module is configured to control the fuel consumption of the internal combustion engine via an economy fuel map in response to the throttle input value falling within the defined limits for a predetermined amount of time and the throttle input values remain below the throttle input value threshold, and the standard fueling mode activation module is configured to control the fuel consumption of the internal combustion engine via a standard fuel map in response to at least one of the throttle input value not falling within the defined limits for the predetermined amount of time and the throttle input values exceed the throttle input value threshold.

7. The controller of claim 6, wherein the economy fuel map and standard fuel map each comprises respective fuel addition values for various operating conditions of the engine, and wherein the fuel addition values of the economy fuel map are lower than the fuel addition values of the standard fuel map for the same operating conditions of the engine.

8. A controller for controlling fuel consumption in an internal combustion engine of a vehicle having a driver-actuated accelerator pedal, comprising:

an economy fueling mode activation module configured to receive a throttle input value representing a throttle valve position and determine whether the throttle input value falls within defined limits, the throttle input value being controllable by a driver of the vehicle via positioning of the accelerator pedal, wherein the economy mode activation module is configured to activate an economy fueling mode in response to determining the throttle input value falls within the defined limits for a defined amount of time while the internal combustion engine is operating under a standard fueling mode, the economy fueling mode requiring less fuel consumption than the standard fueling mode;

a standard fueling mode activation module configured to receive the throttle input value and determine whether the throttle input value falls within the defined limits, wherein the standard fueling mode activation module is configured to activate the standard fueling mode in response to determining the throttle input value does not fall within the defined limits for the defined amount of time while the internal combustion engine is operating under the economy fueling mode; and at least one economy fuel map corresponding to the economy fueling mode, and a standard fuel map corresponding to the standard fueling mode, wherein:

the economy mode activation module comprises a steady state economy mode activation module, the throttle input value comprises throttle input values corresponding with positions of the accelerator pedal, the defined limits comprise predetermined throttle input value limits, the at least one economy fuel map comprises a steady state economy fuel map, and the predetermined amount of time comprises a first defined amount of time;

the apparatus further comprises an acceleration economy mode activation module configured to compare throttle input rate of change values with defined throttle input rate of change value limits, the throttle input rate of change values being controllable by the driver of the vehicle via positioning of the accelerator pedal over time, and the at least one economy fuel map comprises an acceleration economy fuel map, wherein the acceleration economy mode activation module is configured to control the fuel consumption of the internal combustion engine via the acceleration economy fuel map in response to the throttle input rate of change values falling within the throttle input rate of change value limits for a second defined amount of time; and the standard fueling mode activation module is configured to control the fuel consumption of the internal combustion engine via the standard fuel map in response to the throttle input values not falling within the defined throttle input value limits for the first defined amount of time and the throttle input rate of change values do not fall within the throttle input rate of change value limits for the second defined amount of time.

9. The controller of claim 8, wherein the steady state economy fuel map and acceleration economy fuel map are the same.

10. The controller of claim 8, wherein the steady state economy fuel map and acceleration economy fuel map are different.

11. The controller of claim 1, wherein the defined limits comprise limits determined statically prior to operation of the engine.

12. The controller of claim 1, wherein the defined limits comprise limits determined dynamically during operation of the engine.

13. A controller for controlling fuel consumption in an internal combustion engine of a vehicle having a driver-actuated accelerator pedal, comprising:

an economy fuel map, wherein the economy fuel map comprises a steady state fuel map;

a standard fuel map;

an acceleration fuel map; and an operating mode determination module configured to:

receive a throttle input value representing a throttle valve position and switch control of a fueling operation mode of the engine to an economy fueling mode based on an economy fuel map from a standard fueling mode based on the standard fuel map and switch control of the fueling operation mode of the engine to the standard fueling mode from the economy fueling mode, the switching of the fueling operation mode of the engine based on the throttle input value; and switch control of the fueling operation of the engine between the steady state fuel map, acceleration fuel map, and standard fuel map based on whether the position of the accelerator pedal remains within first limits for a first amount of time and whether a rate of change of the position of the accelerator pedal remains within second limits for a second amount of time.

14. The controller of claim 13, wherein control of the fueling operation of the engine is switchable between the economy and standard fuel maps via driver-controlled actuation of the accelerator pedal.

15. A method for controlling fuel consumption in an internal combustion engine of a vehicle having a driver-actuated accelerator pedal, comprising:

determining whether a throttle input value falls within defined upper and lower limits for a defined period of time, wherein the throttle input value corresponds with rates of change of the position of the accelerator pedal;

generating a fuel command for the engine operating under a standard fueling mode based on a standard fuel map to switch to an operation under an economy fueling mode based on an economy fuel map in response to the throttle input value falling within the defined upper and lower limits for the defined period of time, the economy fueling mode requiring less fuel consumption than the standard fueling mode; and generating a fuel command for the engine operating under the economy fueling mode to switch to an operation under the standard fueling mode in response to the throttle input value not falling within the defined upper and lower limits for the defined period of time, wherein the economy mode is an acceleration economy mode.

16. The method of claim 15, wherein the throttle input value comprises a position of a throttle of the engine.

17. A method for controlling fuel consumption in an internal combustion engine of a vehicle having a driver-actuated accelerator pedal, comprising:

determining whether a throttle input value falls within defined upper and lower limits for a defined period of time, wherein the throttle input value comprises a rate of change of the position of a throttle of the engine generating a fuel command for the engine operating under a standard fueling mode based on a standard fuel map to switch to an operation under an economy fueling mode based on an economy fuel map in response to the throttle input value falling within the defined upper and lower limits for the defined period of time, the economy fueling mode requiring less fuel consumption than the standard fueling mode; and generating a fuel command for the engine operating under the economy fueling mode to switch to an operation under the standard fueling mode in response to the throttle input value not falling within the defined upper and lower limits for the defined period of time.

18. The method of claim 15, further comprising, responsive to receiving an indication of actuation of the accelerator pedal, switching between generating the fuel command for the engine based on the economy fuel map and generating the fuel command for the engine based on the standard fuel map.

* * * * *